US006070747A

United States Patent [19]

Shea

[11] Patent Number: 6,070,747

[45] Date of Patent: Jun. 6, 2000

[54] MERCHANDISING DISPLAY STRUCTURE

[76] Inventor: Thomas M. Shea, 1343 Rochester Rd., Suite 100, Troy, Mich. 48083

[21] Appl. No.: 09/225,671

[22] Filed: Jan. 5, 1999

Related U.S. Application Data

[63] Continuation-in-part of application No. 08/599,407, Nov. 26, 1995, Pat. No. 5,660,286, and a continuation-in-part of application No. 08/829,837, Apr. 1, 1997.

[51] Int. Cl.[7] ..... A47F 5/00

[52] U.S. Cl. ..... 211/87.01; 211/57.1; 211/106; 211/105.3; 211/103; 248/220.31; 248/220.41

[58] Field of Search ..... 211/87.01, 106, 211/105.3, 208, 94.01, 59.1, 57.1, 103, 187; 248/220.31, 220.41, 220.43, 221.11, 222.14

[56] References Cited

U.S. PATENT DOCUMENTS

| | | | |
|---|---|---|---|
| D. 320,719 | 10/1991 | Kolsrud et al. . | |
| D. 327,187 | 6/1992 | Swon . | |
| 431,110 | 7/1890 | Driver . | |
| 2,020,991 | 11/1935 | Brody . | |
| 2,935,210 | 5/1960 | Cohen . | |
| 3,018,898 | 1/1962 | Frazelle . | |
| 3,087,624 | 4/1963 | Hucker . | |
| 3,221,893 | 12/1965 | Glaberson et al. . | |
| 3,513,606 | 5/1970 | Jones . | |
| 3,677,415 | 7/1972 | Radek . | |
| 4,159,814 | 7/1979 | Fibus . | |
| 4,181,230 | 1/1980 | Acuff | 211/208 |
| 4,340,144 | 7/1982 | Cousins | 211/87.01 |
| 4,697,712 | 10/1987 | Valiulis | 211/187 |
| 4,720,016 | 1/1988 | Kay . | |
| 4,919,280 | 4/1990 | Phillips . | |
| 5,090,725 | 2/1992 | Feldner . | |
| 5,104,269 | 4/1992 | Hardison | 211/105.3 X |
| 5,443,167 | 8/1995 | Menaged et al. . | |
| 5,505,318 | 4/1996 | Goff . | |
| 5,505,319 | 4/1996 | Todd, Jr. . | |
| 5,556,064 | 9/1996 | Cowe . | |
| 5,657,884 | 8/1997 | Zilincar, III . | |
| 5,660,286 | 8/1997 | Shea . | |
| 5,678,702 | 10/1997 | Menaged et al. . | |
| 5,957,422 | 9/1999 | Shea | 248/220.31 |

*Primary Examiner*—Robert W Gibson, Jr.
*Attorney, Agent, or Firm*—Gifford, Krass, Groh, Sprinkle, Anderson & Citkowski, P.C.

[57] ABSTRACT

A merchandising display assembly structure mounted to a vertical support surface, the support surface having an elongate and single slotted backplate with a plurality of spaced apart and linearly extending slots. At least one horizontally extending member is mounted to and extends from the support surface. The horizontally extending member in a specific embodiment includes first and second elongated portions and axially adjusting means for establishing a length between the elongated portions. An elongated display member is secured to an outer end of the at least horizontal member and extends in parallel fashion relative to the vertical support surface at a spaced distance. The display member exhibits a substantially flattened display area for securing thereon a plurality of hanger portions which are in turn capable of supporting large volumes of small sized merchandise without obscuring additional merchandise located on the vertical support surface.

12 Claims, 8 Drawing Sheets

MERCHANDISING DISPLAY STRUCTURE

CROSS REFERENCE TO COPENDING APPLICATIONS

The present application is a continuation-in-part of U.S. application Ser. No. 08/599,407, filed Nov. 26, 1995 for a Merchandising Display Structure, now U.S. Pat. No. 5,660,286, and a continuation-in-part of U.S. application Ser. No. 08/829,837, filed Apr. 1, 1997, for a Merchandising Display Structure.

BACKGROUND OF THE INVENTION

1. Field of the Invention

The present invention relates generally to merchandising display assemblies and, more particularly, to a merchandising display structure which is securable to a vertical support surface and which includes an elongated and substantially flattened display surface area attached to one or more horizontally extending members and being spaced a distance from the vertical support, the display surface area being capable of supporting volumes of smaller sized merchandise.

2. Description of the Prior Art

Shelving structures and related display units for displaying merchandise are a common sight in any type of store or commercial establishment. The desire of any merchant is and always has been to maximize the available shelf or display capacity within the limited confines of the store. Vertically extending pegboard surfaces are particularly effective for displaying small, high volume merchandise on hooks and other horizontally extending fasteners.

U.S. Pat. No. 3,677,415, issued to Radek, teaches a cantilever merchandise support including an article supporting hanger bar or bracket which is adapted to be attached to a perforated board or panel by a plurality of legs extending from a mounting plate. The hanger bar or bracket portion is in each instance an integrally formed single piece which is mounted to extend outwardly from the vertical surface and upon which the merchandise is supported. The disadvantage of cantilevered merchandise supports such as those taught by Radek is that their merchandise carrying capacity is limited to the bar or bracket portion. The axial length which such supports extend is likewise limited such that they are unable to utilize to any great extent the air space extending from the pegboard or other surface for displaying merchandise.

U.S. Pat. No. 5,014,954, issued to Merl, discloses an adjustable display arm assembly securable to a vertical support structure which includes a pair of nesting segments selectively adjustable at longitudinal positions to establish an overall length of the display arm. The Merl device is somewhat of an improvement over Radek in that the display arm can be extended outward a greater horizontal distance, however its merchandise carrying ability is still limited to the display arm itself and it does not include any additional bracketry for carrying large volumes of merchandise.

SUMMARY OF THE PRESENT INVENTION

The present invention is a merchandising display assembly which may be mounted to a vertical support surface, the support surface being of a number of different conventionally known supporting surfaces such as single slotted and vertically extending backplate surfaces, pegboard surfaces having a number of apertures formed therethrough and the like. At least one horizontally extending arm is provided and includes first and second elongated portions which are axially adjustable to modify the overall length of the arm. A support surface engaging portion is attached to a free end of the first elongated portion and is suitable for engaging with a singled slotted and vertically extending bracket for mounting the arm in a horizontally extending fashion relative the vertical surface.

An elongated display member is provided in the form of an elongated and substantially flattened display surface area attached to a free end of the at least one second elongated portion and extends parallel and at a spaced distance from the vertical support surface. According to a first preferred variant, the display surface area includes a first and second planar shaped grids defining first and second sides of the display. An elongate and rectangular cross sectional shaped display member may also be utilized as interconnecting the at least one horizontal arm and the grids.

According to a further variant, the flattened display surface area includes a flattened display board through which is formed a large plurality of spaced apertures formed along the length of the display board at spaced apart intervals which are designed to receive hooks or other conventional hangers for supporting large volumes of small sized packaged merchandise. The advantage of the display member is that it can support a relatively large volume of small, high volume merchandise a spaced distance from the pegboard or other vertical surface without obscuring other additional items displayed on the vertical board or shelf surface. The overall advantage of the present invention is that it greatly increases the merchandise display capacity of such a conventional display structure by utilizing to a much greater extent the unused air space in the area in front of the display surface.

BRIEF DESCRIPTION OF THE DRAWING

Reference will now be made to the attached drawing, when read in combination with the following description of the preferred embodiments, wherein like reference numerals refer to like parts throughout the several views, and in which.

DETAILED DESCRIPTION OF THE PREFERRED EMBODIMENTS

Figure 1:
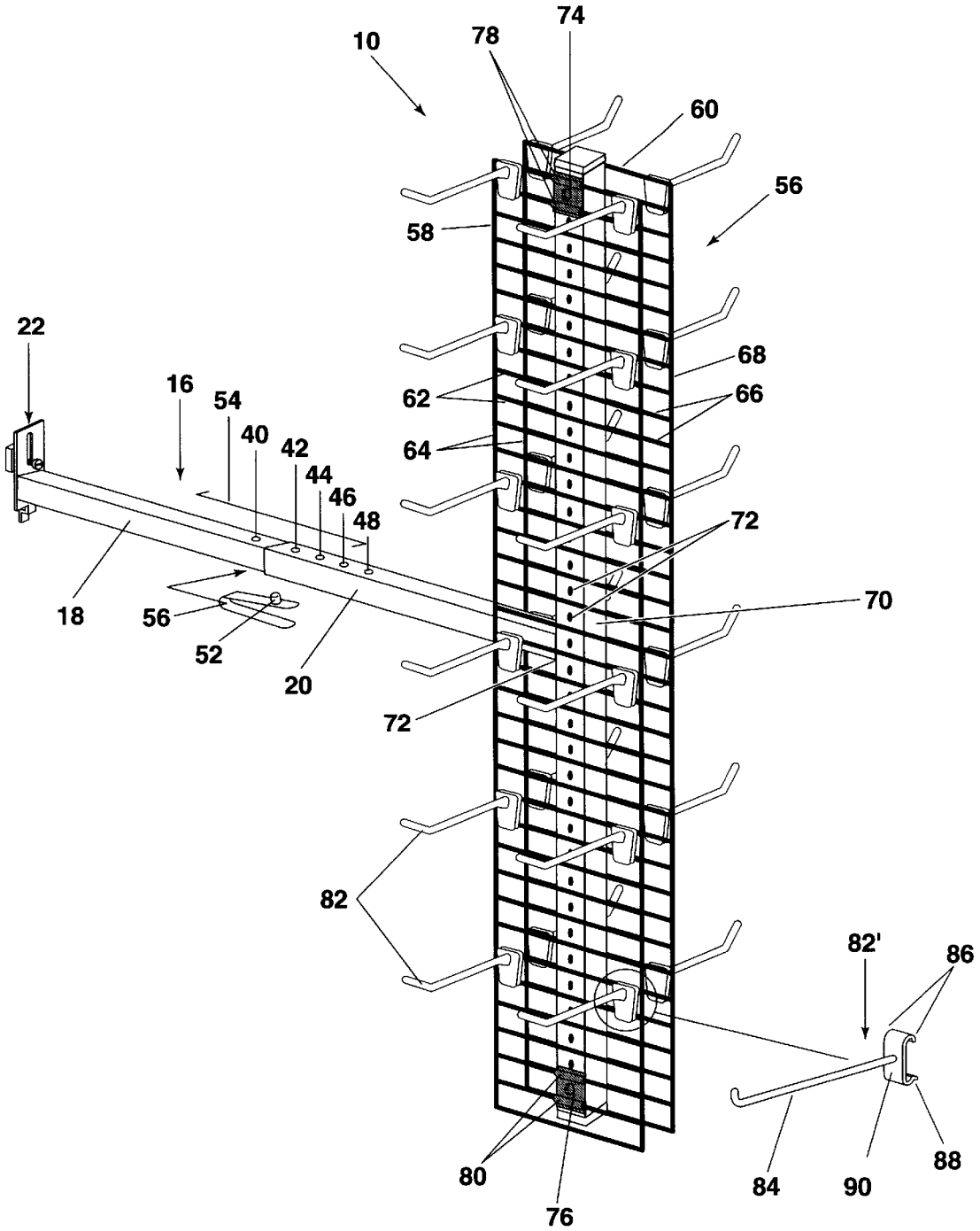
FIG. 1 is a perspective view of a merchandising display structure according to a first preferred embodiment of the present invention.

Referring now to FIG. 1, a merchandising display assembly 10 is shown mounted to a vertical support surface 12 (as is further illustrated in FIG. 5) and which is provided as an elongate single slotted backplate having a plurality of spaced apart and linearly extending slots 14. The vertical support surface in other conventional embodiments may typically also include a holed pegboard type surface upon which volumes of small merchandise are displayed using hooks or hangers but can also be provided by any other surface such as a vertical face of a horizontal shelving support or the face of a vertically extending support of such a shelving support. The advantages of utilizing the merchandising display assembly according to the present invention with the various kinds of conventional shelving displays will be subsequently described.

Referring again to FIG. 1, the merchandising display assembly 10 includes a single horizontally extending member 16 having a first elongated portion 18 and a second elongated portion 20. The first extending member 16 extends from the vertical support surface 12 by means of a support portion 22. Referring again to the enlarged view of FIG. 5, the support portion 22 includes a planar shaped member 24 connected to an end 26 of the first elongated portion 18, preferably by welding. A downwardly and forwardly stepped portion 28 extends from a bottom edge of the planar shaped member 24. A means for mounting the support portion 22 to the slotted backplate 12 further includes a vertical slotted portion 30 formed along a predetermined length of the planar shaped member 24. A screw 32 projects through the slotted portion 30 and a first selected linearly extending slot 14' of the backplate 12. A square shaped nut 34 sets upon a projecting end 36 of the screw 32 and is subsequently rotatable to a 90 degree position as shown in phantom at 34' upon being inserted within the hollow interior of the support portion 22 and upon seating the downwardly and forward stepped portion 28 within a further selected linearly extending slot 14" and so as to releasably secure the support portion to the vertical backplate.

Referring again to FIG. 1, the first elongated portion 18 forms an inner telescoping portion and the second elongated portion 20 forms an outer telescoping portion. The first and second elongate portions 18 and 20 are polygonal shaped in cross section and range from three sides, corresponding to a triangle, to an infinite number of sides corresponding to a circular cross section. Preferably however, the cross sectional configuration of the elongated or telescopic portions is rectangular.

An end of the inner telescoping portion which is opposite to the support portion 22 is received within an opposing end of the outer telescoping portion. A single aperture 40 is formed along an upper face of the rectangular cross section of the inner telescoping portion and is selectively and slidably aligned with one of a plurality of apertures 42, 44, 46 and 48 formed along an overlapping face of the outer telescoping portion. The single aperture 40 of the first telescoping portion 18 is shown in FIG. 1 for purposes of illustration spaced from the plurality of apertures 42, 44, 46 and 48, however it being understood that the telescoping portions are coaxially adjusted so that the aperture 40 aligns with a selected one of the plurality of apertures.

An outwardly biasing spring-loaded pin 50 is inserted within the end of the inner telescoping portion so that an outwardly biasing button portion 52 of the pin 50 projects through the single aperture 40 and one of the associated apertures 42, 44, 46 and 48 of the overlapping outer tubular portion so as to readjust the overall length of the horizontal member in one of two directions along the directional arrow 54. This is accomplished simply by pressing the button portion 52 inwardly and then axially sliding the inner and outer telescoping members relative to one another until a desired aperture of the plurality of apertures aligns over the single aperture, at which point the button portion will again project upwardly through the apertures snapping the horizontal member in place. The use of the spring-loaded pin 50 with outwardly biasing button portion 52 is a further improvement over prior art telescoping assemblies which require extraneous threaded bolts and other removable fasteners which can be easily misplaced or lost in normal use.

Figure 5:
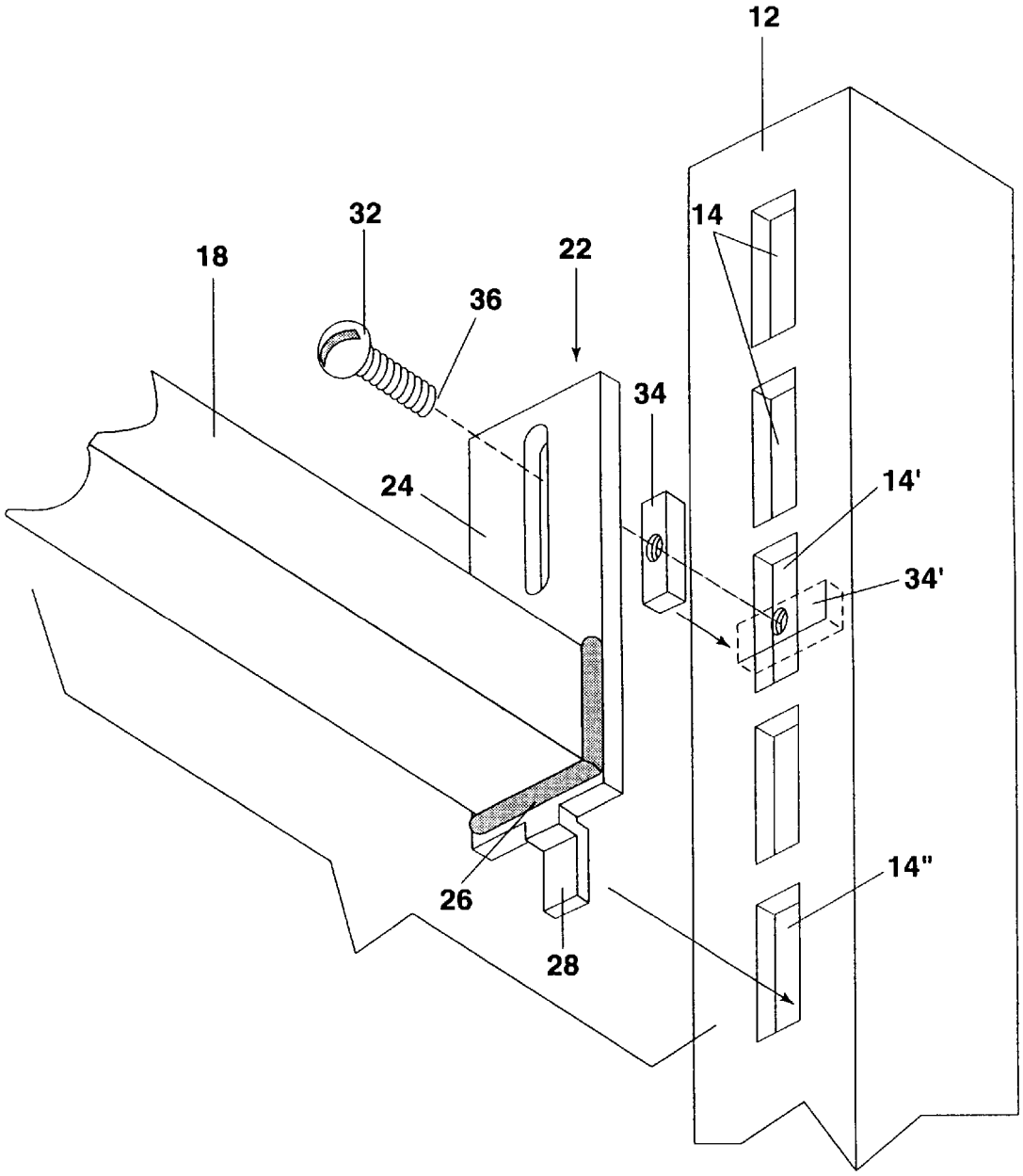
FIG. 5 is an exploded view in section of a support surface engaging portion for use with the merchandising display structure according to the present invention.

An elongated and substantially flattened display member 56 is attached to a free end of the second elongated portion 20 (or outer tubular member) and so that it extends parallel and at a spaced distance from the vertical support surface (again at 12 in FIG. 5). According to the first preferred embodiment, the elongated and substantially flattened display member 56 further includes a first grid pattern 58 and a second spaced apart and parallel extending grid pattern 60. Each of the grid patterns 58 and 60 is constructed of a pattern of interlocking wire elements such as at 62 and 64 for first grid pattern 58 and at 66 and 68 for second grid pattern 60.

An elongate and rectangularly cross sectional shaped member 70 may be secured to the second telescopic portion 20 or outer tubular member to likewise extend parallel at a spaced distance from the vertical support surface. The member 70 may function itself as a display member, such as in the preceding applications from which the instant application claims priority. To this end, a series of apertures 72 are illustrated running lengthwise at spaced apart intervals along the member 70.

In the preferred embodiment, however, the member 70 functions as an interconnection between the horizontally extending member 16 and the first and second grid patterns 58 and 60. This is accomplished by clamps 74 and 76 which are secured at top and bottom locations to apertures 72 in the member 70. Each of the clamps 74 and 76 includes a pair of horizontal and parallel extending slots (see pairs of slots 78 and 80 for claims 74 and 76). A screw is provided for securing each of the clamps to the associated aperture in the member 70 and is tightened to grips the portions of the horizontally extending wire elements 62 and 66 of the first and second grids 58 and 60, respectively, which extend through the pairs of slots 78 and 80.

A plurality of hanger portions 82 are provided which are engageable between succeeding pairs of horizontally extending wire elements 62 and 66 of the first and second grids 58 and 60. The hanger portions 82 are constructed in a fashion known in the art and, as is further illustrated in the specific hanger portion 82' indicated portion in FIG. 1, includes an elongate hanger 84 upon which is supported a plurality of smaller sized merchandising (not shown) as well as tab pairs (angled at 86 and straight at 88) which extend from a rear side of a plate portion 90 and which are engageable with the spaced wire elements of the grid portions.

The construction of the grids 58 and 60 which make up the elongate display are further an improvement over the prior art in that they each provide a significantly increased volume of merchandise carrying capability beyond that which has been previously possible in the art. The positioning of the grids 58 and 60 is further accomplished by telescoping the inner and outer members 18 and 20 in the direction desired so that the display faces of the grids are easily accessible to the shoppers and without projecting into the aisle ways of the stores so as to avoid the incidence of injury by individuals running into the display structures.

Figure 2:
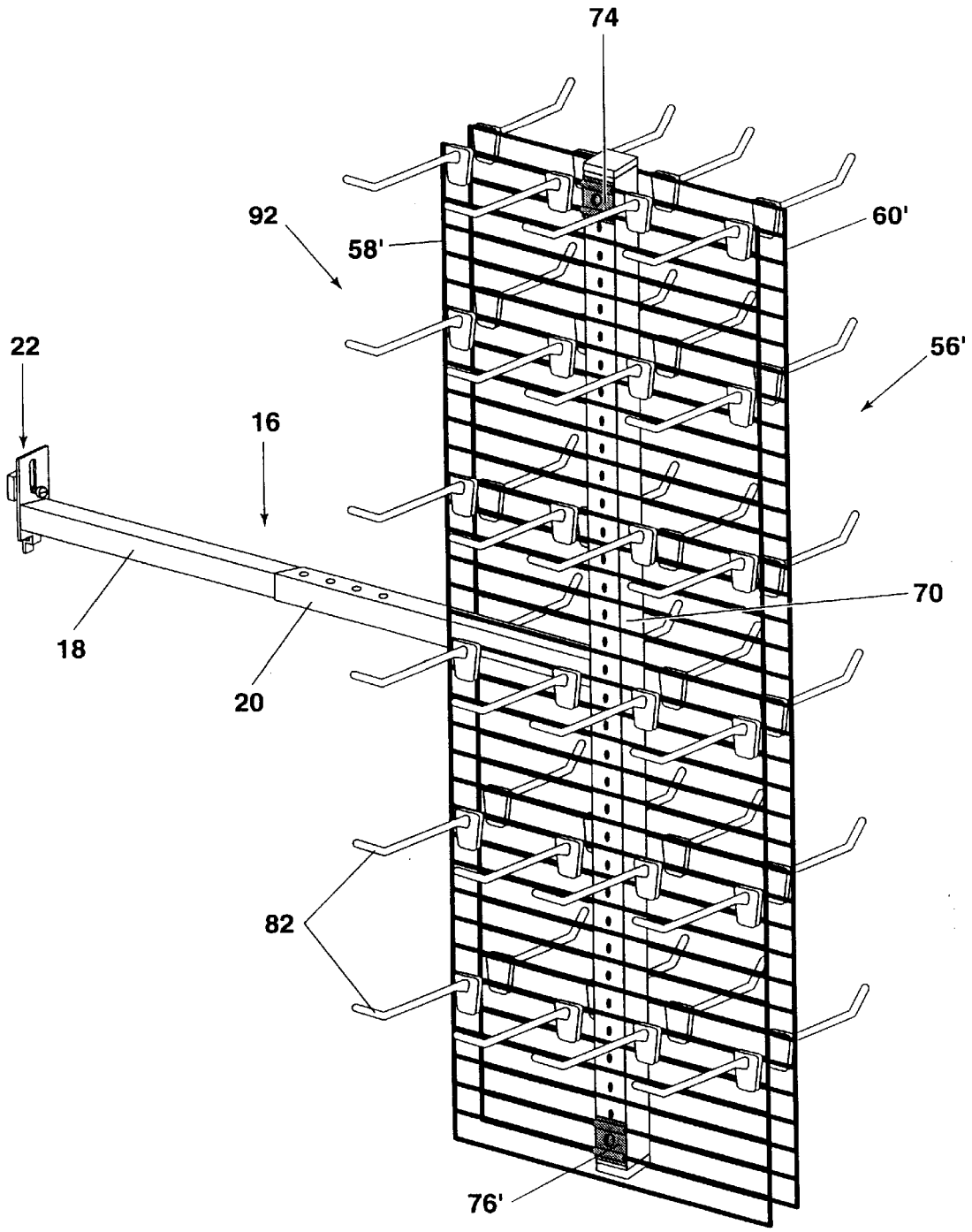
FIG. 2 is a perspective view of a modification of the first preferred embodiment and illustrating differently shaped first and second display area grids according to the present invention.

Referring further to FIG. 2, a modification is shown at 92 of the merchandising display structure according to the first preferred embodiment and which differs from the first embodiment 10 in that a selected width of first and second grids 58' and 60' of display 56' is increased two-fold, such as from 6" to 12" in horizontal length. According to the preferred embodiment, the height of the grids 58' and 60' remains at 36" which is consistent with the preferred embodiment illustrated in FIG. 1. Aside from this, the remaining features of the modification 92 are all identical to the first embodiment 10 and include horizontal member 16 with first and second telescoping portions 18 and 20, support portion 22 for engaging with the vertical support surface 12, and interconnecting vertical member 70 to which the grids 58' and 60' are secured via clamps 74 and 76.

Figure 3:
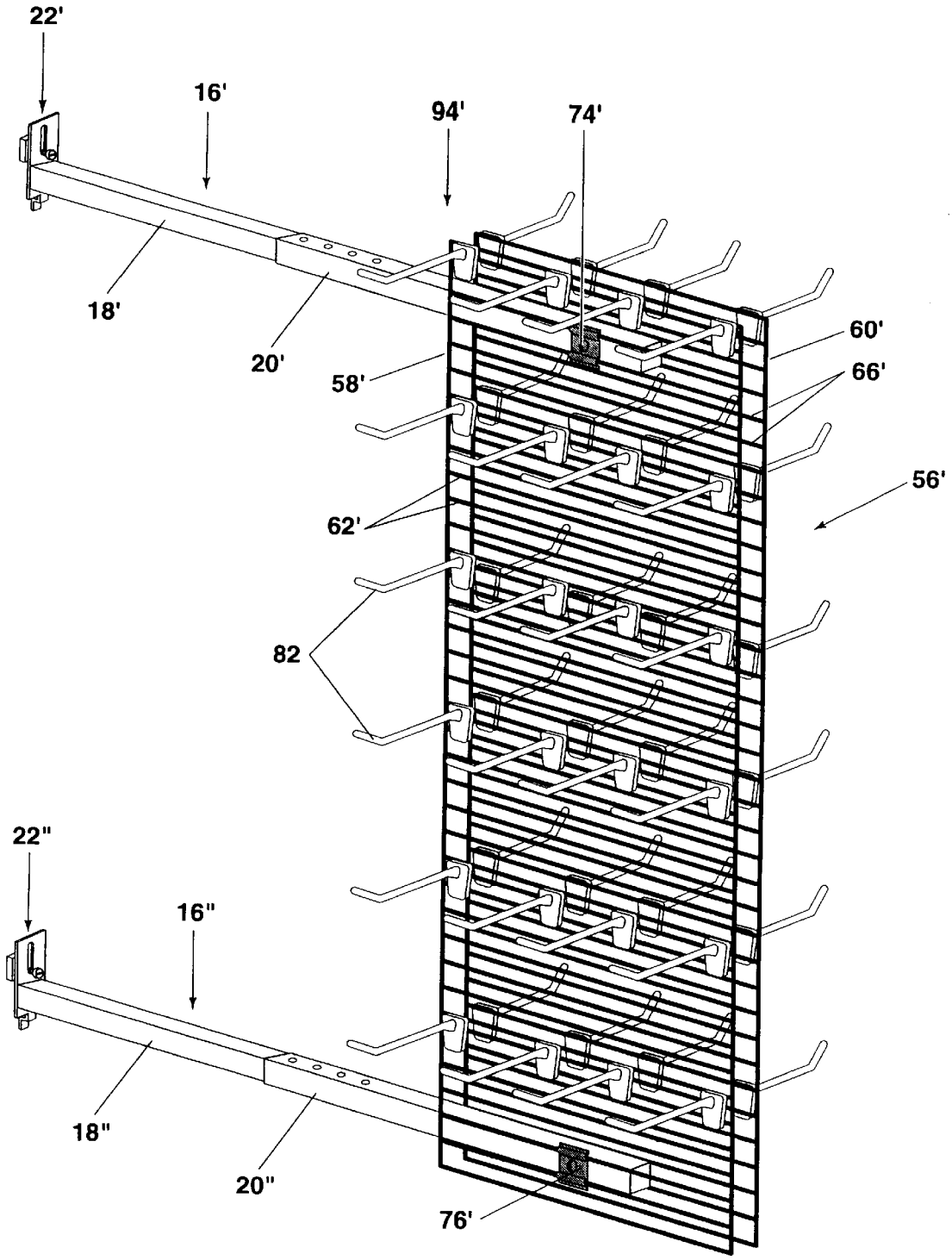
FIG. 3 is a perspective view of an alternative variant of the merchandising display structure according to the first preferred embodiment of the present invention.
Figure 4:
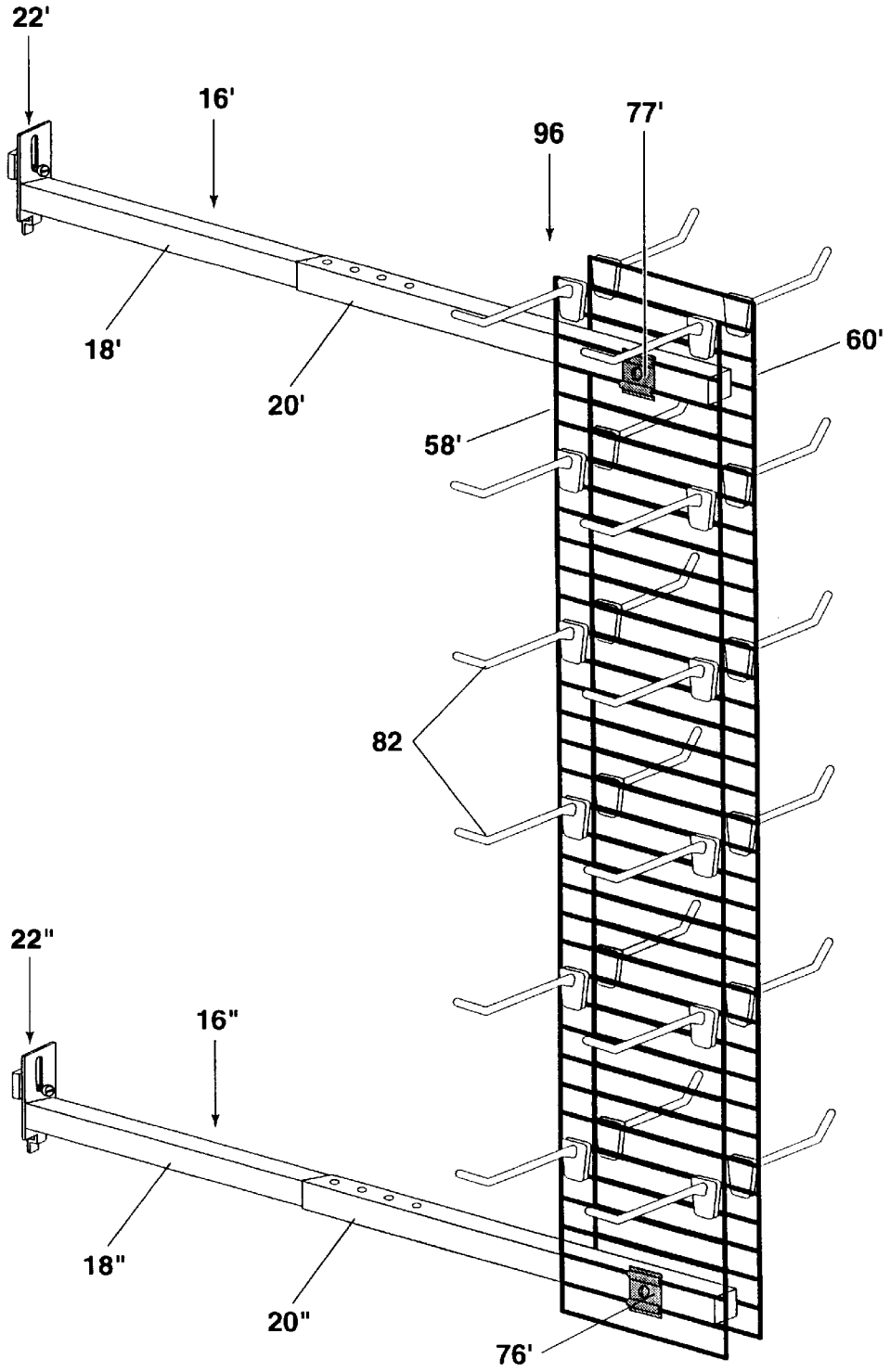
FIG. 4 is a perspective view of a modification of the alternative variant of the first preferred embodiment of the merchandising display structure according to the first preferred embodiment of the present invention.

Referring further to FIGS. 3 and 4, additional modifications of the first preferred embodiment are shown which are largely identical to each other, except as to dimension. Specifically, FIG. 3 illustrates a modification 94 of the merchandising display structure in which the grids 58' and 60' as shown in FIG. 2 are represented and the vertical member 70 removed so that a first horizontally extending member 16' constructed of first and second telescoping members 18' and 20' and a second horizontally extending 16" constructed of first and second telescoping members 18" and 20" is clamped directly to the first and second grids 58' and 60'. This is accomplished by applying upper and lower clamps 74' and 76' directly over aligning portions of horizontally extending wire elements (see at 62' and 66', respectively). Screws are provided and insert through the clamps and aligning holes in the sides of the second upper and lower telescoping members 20' and 20" (not illustrated but evident from the view of FIG. 3) and so as to directly clamp the grids 58' and 60' to the pair of upper and lower horizontal members 16' and 16". The grids 58' and 60' are further defined at a spacing equivalent to the thickness of the second outer tubular portions 20' and 20" and, as with the variants in FIGS. 1 and 2, are capable of receiving a large volume of hanger portions for in turn supporting large volumes of smaller sized merchandising. Support portions 22' and 22" are again provided for securing the merchandising display structure 94 to a suitable vertical surface, again such as a single slotted backplate surface or the like.

Referring to FIG. 4, a further modification 96 is illustrated of the merchandising display structure and which identically represents the grids 58 and 60 as shown in FIG. 1, along with the first 16' and second 16" horizontally extending members of FIG. 3. Further the ends of the outer tubular portions 20' and 20" fasten directly to the grids 58 and 60, through use of the clamps 74' and 76', and so as to facilitate the supporting engagement of a plurality of hanger portions 82 for small sized merchandising, the grids 58 and 60 again being capable of being inwardly and outwardly telescopically engaged for suitable adjustment relative to the vertical support surface 12.

Figure 6:
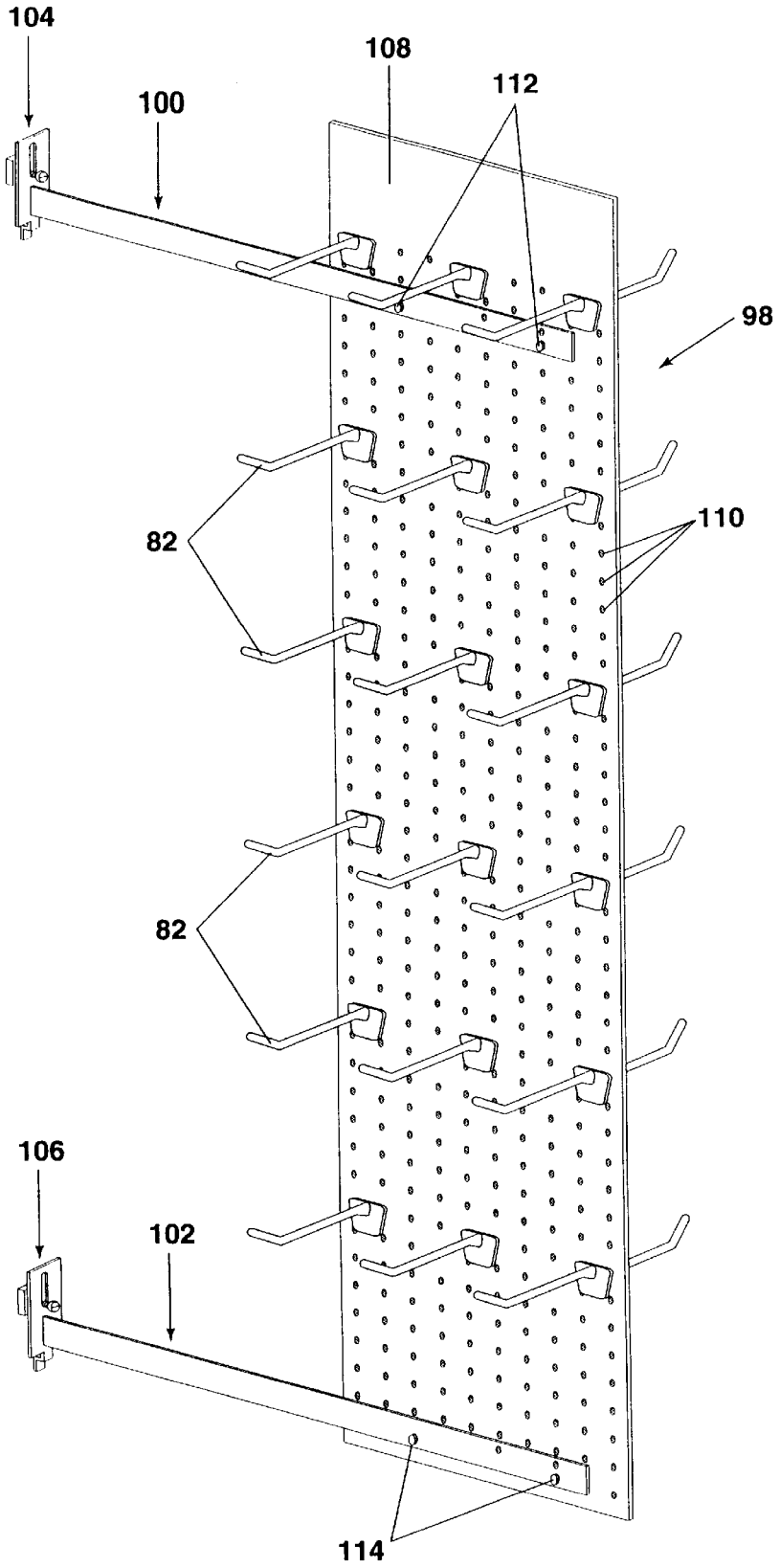
FIG. 6 is a perspective view of the merchandising display structure according to a further preferred embodiment of the present invention.

Referring now to FIG. 6, a merchandising display structure 98 is illustrated according to a further preferred embodiment and which includes first and second horizontally extending and substantially integrally formed and planar shaped elements 100 and 102. Secured to first ends of the elongate and horizontally extending members 100 and 102 which are substantially planar shaped in cross section and which are affixed to the vertical support surface 12 by support portions 104 and 106 (identical to those of the first preferred embodiment and modifications thereof).

An elongated and substantially flattened display member 108 is provided in the form of a substantially flattened sheet of material, such as a durable polymer construction, and having disposed therein a large plurality of apertures 110 at spaced apart intervals. The display member 108 is secured to the horizontally extending members by means of a first pair of upper pins 112 and a second pair of lower pins 114 which extend through the planar faces of the horizontal members 100 and 102 at spaced locations and insert within selected apertures 110 formed in the display member 108. As with the first preferred embodiment, a plurality of the hanger portions 82 as known in the art are provided for engaging within selected apertures or pairs of apertures to in turn support volumes of merchandising upon the display structure. The construction of the hanger portions for making them amenable for being mountable upon the display member 108 is provided as is described in FIG. 1.

Figure 7:
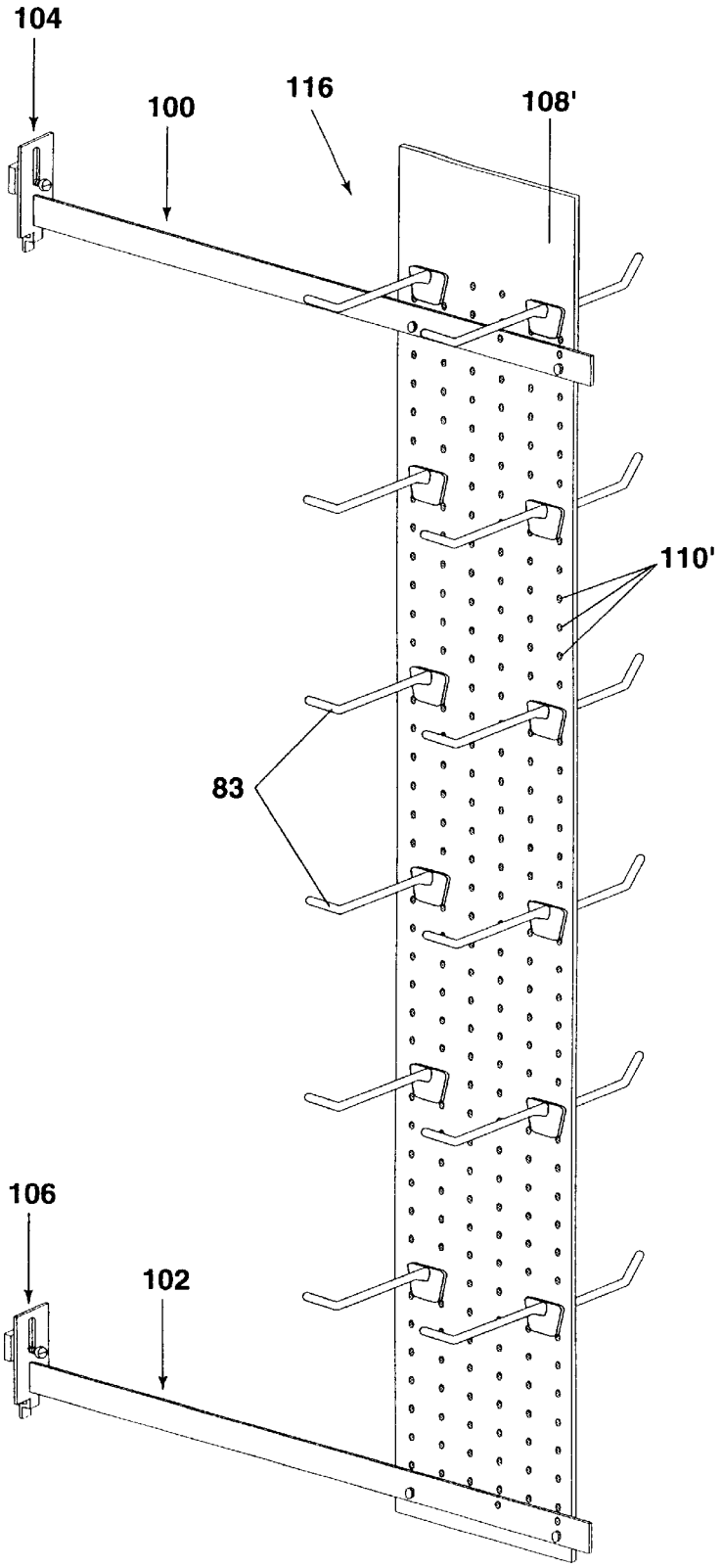
FIG. 7 is a perspective view of a modification of the merchandising display structure according to the further preferred embodiment of the present invention.

Referring to FIG. 7, a modification 116 is provided of the display structure according to the second preferred embodiment and includes substantially the identical structure as disclosed in FIG. 6, with the exception that display member 108' is slightly modified in overall shape. Specifically, display member 108' according to its preferred commercial variant includes a 48" height and a 6" width as opposed to the display member 108 which is 48" in height and 10" in width. The remaining structure of the modification 116 is identical in each and every other respect to that shown at 98 in FIG. 6.

Figure 8:
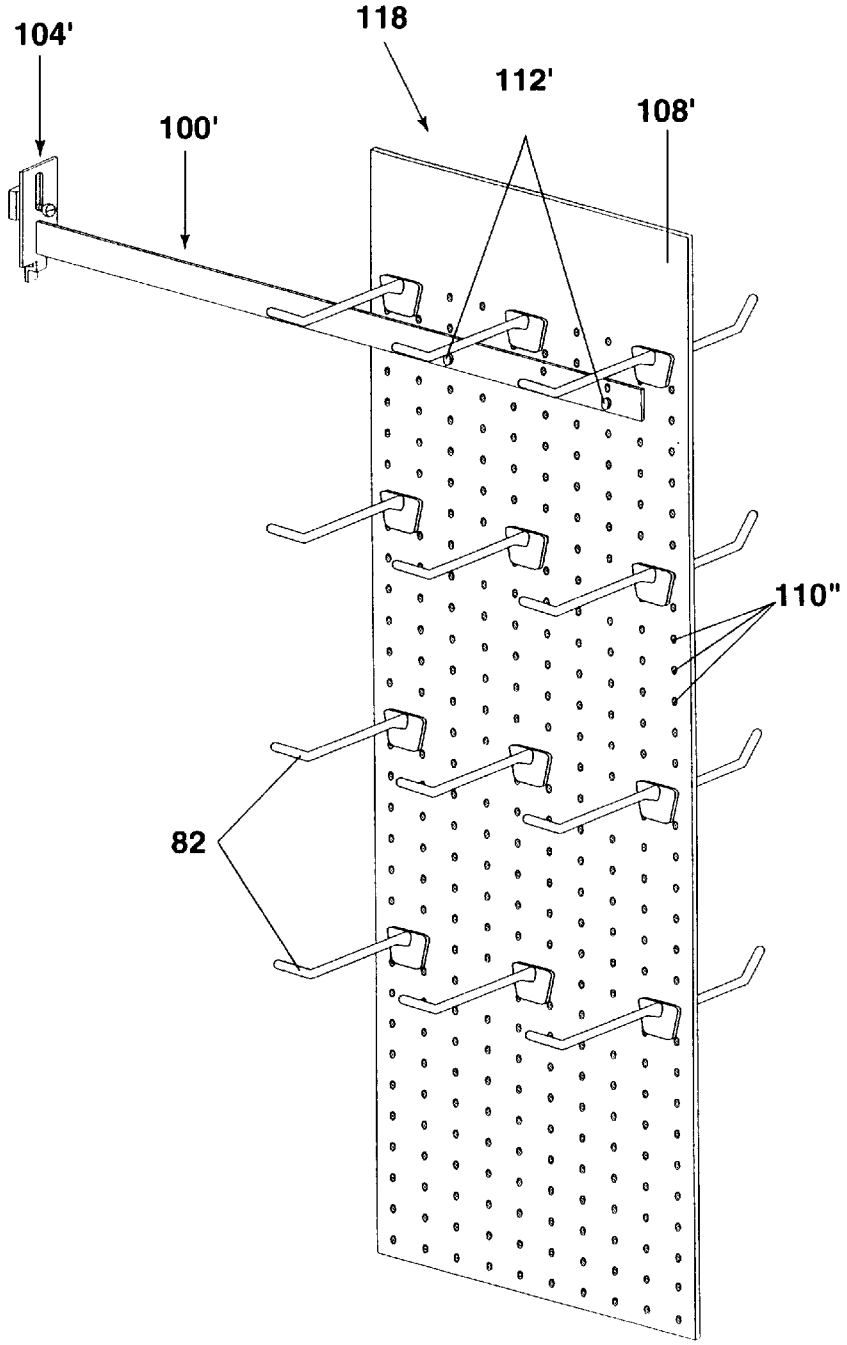
FIG. 8 is a perspective view of yet a further modification of the merchandising display structure according to the further preferred embodiment of the present invention.

Referring finally to FIG. 8, a final modification 118 is shown of the merchandising display structure according to the present invention and differs only slightly from that shown in the variants of 98 and 116 in FIGS. 6 and 7, respectively. Specifically, the variant 118 of FIG. 8 utilizes only a single upper horizontally extending member 100' with a support portion 104'. As illustrated in both FIGS. 6 and 7, a pair of pins 112' insert through apertures in the planar surface of the horizontal member 100' and aligning selected apertures 110" of the display member 108". Again, hanger portions 82 are provided and affix to additional and selected pairs of apertures 110" to in turn support the desired volumes of merchandise. The configuration of the display member 108" is such that it exhibits a 36" height and a 10" width.

It is understood that the preceding discussion cover only the most preferred embodiments of the merchandising display assembly according to the present invention and that other shapes and designs may also be employed. Specifically, more than two horizontally extending members may be employed with one or more vertically or horizontally extending display members. Other types of affixing means may also be utilized in the support portions for mounting them to the vertically extending surface. Finally, the merchandise display assembly according to the present invention is capable of being used with just about any vertically extending surface aside from a pegboard surface, such as a vertical face of a horizontal shelving unit or a vertically extending post having the appropriate apertures formed therein. Having described my invention, other additional embodiments will become apparent to those skilled in the art to which it pertains according to the appended claims:

I claim:

1. A merchandising display structure mounted to a vertical support surface, said display structure comprising:

at least one horizontally extending member including a first elongated portion, a second elongated portion secured to said first elongated portion and adjusting means for axially spacing said second elongated portion relative to said first elongated portion;

a support portion including a planar shaped member which is welded to a free end of said first elongated portion, said support portion including mounting means which engage with the vertical support surface to mount said at least one horizontally member in an extending fashion from the support surface, the vertical support surface being an elongate single slotted backplate having a plurality of spaced apart and linearly extending slots, said mounting means further comprising a downwardly and forwardly stepped portion extending from a bottom edge of said planar shaped member, said mounting means further comprising a vertical slotted portion formed along a predetermined length of said planar shaped member, a screw projecting through said slotted portion and a first selected linearly extending slot of said backplate, a square shaped nut setting upon a projecting end of said screw and subsequently rotatable, upon seating said downwardly and forwardly stepped portion within a further selected linearly extending slot, to engage a rear surface of the backplate; and an elongated and substantially flattened display member attached to a free end of said second elongated portion and extending parallel and at a spaced distance from the vertical support surface, said display member including receiving means at spaced intervals along said display member for receiving a volume of merchandise.

2. The merchandising display structure as described in claim 1, said first elongated portion further comprising an inner telescoping portion and said second elongated portion an outer telescoping portion, said inner telescoping portion being received within said outer telescoping portion and said outer telescoping portion projecting from an end of said inner telescoping portion opposite said support portion.

3. The merchandising display structure as described in claim 2, said inner and outer telescoping portions each having a hollow interior and said axially adjusting means further comprising a plurality of spaced apart holes which are placed along said outer telescoping portion, a spring loaded pin projecting through a hole in said inner telescoping member and being selectively aligned with one of said plurality of holes in said outer telescoping portion to slidingly engage said inner tubular member with said outer tubular member.

4. The merchandising display structure as described in claim 3, said inner and outer telescoping portions being polygonal shaped in cross section.

5. The merchandising display structure as described in claim 4, said inner and outer telescoping portions being rectangular shaped in cross section.

6. A merchandising display structure mounted to a vertical support surface, said display structure comprising:

at least one horizontally extending member including a first elongated portion, a second elongated portion secured to said first elongated portion and adjusting means for axially spacing said second elongated portion relative to said first elongated portion;

a support portion attaching to a free end of said first elongated portion, said support portion including mounting means which engage with the vertical support surface to mount said at least one horizontally member in an extending fashion from the support surface; and an elongated and substantially flattened display member attached to a free end of said second elongated portion and extending parallel and at a spaced distance from the vertical support surface, said display member including receiving means at spaced intervals along said display member for receiving a volume of merchandise, said elongated and substantially flattened display member further comprising a first grid pattern of interlocking wire elements establishing a first face and a second spaced and parallel extending grid pattern of interlocking wire elements establishing a second face.

7. The merchandising display structure as described in claim 6, said receiving means further comprising a plurality of hanger portions engageable with selected pairs of horizontally extending and spaced apart wire elements.

8. The merchandising display structure as described in claim 6, further comprising a vertically extending and polygonal shaped member interconnecting said first and second grid patterns and said at least one horizontally extending member.

9. A merchandising display structure mounted to a vertical support surface, said display structure comprising:

at least one horizontally extending member;

a support portion attaching to a first end of said horizontally extending member, said support portion including mounting means which engage with the vertical support surface to mount said at least one horizontally extending member in an extending fashion from the support surface; and an elongated and substantially flattened display member attached to said horizontally extending member and extending parallel and at a spaced distance from the vertical support surface, said display member including receiving means at spaced intervals along said display member for receiving a volume of merchandise, said receiving means comprising a plurality of individual apertures formed along said display member, first and second pins extending from said horizontally extending member at selected locations, said pins seating within aligning apertures in said display member for attaching said display member.

10. The merchandising display structure as described in claim 9, further comprising first and second spaced apart and horizontally extending members for mounting said display member to the vertical support surface.

11. The merchandising display structure as described in claim 9, said receiving means comprising a plurality of individual apertures formed along said display member.

12. The merchandising display assembly as described in claim 9, said receiving means further comprising a plurality of hanger portions selectively engageable within pairs of said apertures formed through said display member.

* * * * *